US005720535A

United States Patent [19]

Mehman

[11] Patent Number: 5,720,535

[45] Date of Patent: Feb. 24, 1998

[54] CABINET CONSTRUCTION AND LOCKING SYSTEM

[75] Inventor: Robert J. Mehman, Shell Rock, Iowa

[73] Assignee: Waterloo Industries, Inc., Waterloo, Iowa

[21] Appl. No.: 704,900

[22] Filed: Aug. 30, 1996

[51] Int. Cl.[6] ..... E05B 65/46

[52] U.S. Cl. ..... 312/219; 312/218; 312/265.2; 312/249.11

[58] Field of Search ..... 312/217, 218, 312/216, 219, 265.1, 265.2, 265.3, 265.4, 249.8, 249.11, 902

[56] References Cited

U.S. PATENT DOCUMENTS

| | | | |
|---|---|---|---|
| 2,286,427 | 6/1942 | Levensten | 312/902 X |
| 2,859,070 | 11/1958 | Gomersall . | |
| 2,952,497 | 9/1960 | Bowden | 312/216 X |
| 3,123,419 | 3/1964 | Maxwell . | |
| 3,393,951 | 7/1968 | Sulentic . | |
| 3,866,993 | 2/1975 | Dean et al. | 312/216 |
| 3,887,253 | 6/1975 | Bridges et al. | 312/249.8 |
| 4,352,529 | 10/1982 | Steinke | 312/219 X |
| 4,662,689 | 5/1987 | Chatterson et al. | 312/219 |
| 4,681,381 | 7/1987 | Sevey . | |
| 4,761,045 | 8/1988 | Paine | 312/219 |
| 4,848,312 | 7/1989 | Roy | 312/216 X |
| 5,221,132 | 6/1993 | Combs et al. | 312/902 X |
| 5,246,286 | 9/1993 | Huebschen et al. | 312/249.8 X |
| 5,435,640 | 7/1995 | Holcomb | 312/221 |

FOREIGN PATENT DOCUMENTS

| | | | |
|---|---|---|---|
| 1130729 | 5/1962 | Germany | 312/219 |

*Primary Examiner*—Peter M. Cuomo
*Assistant Examiner*—Hanh V. Tran
*Attorney, Agent, or Firm*—Banner & Witcoff, Ltd.

[57] ABSTRACT

A multiple drawer, heavy duty cabinet includes a plurality of rectangular, endoskeleton frameworks formed of U-shaped channel members, arrayed in parallel and connected to one another by side, top and bottom panels to define an opening for receipt of slide drawers. A back panel is attached to the cabinet and includes a hinged cover. A locking system is actuated by a key and pull tab through flexible cables and vertical lock bars on the back interior wall of the cabinet.

6 Claims, 8 Drawing Sheets

78
82
88
80
88
68
58
97
44
66
74
62
70
60
72
42
76
40

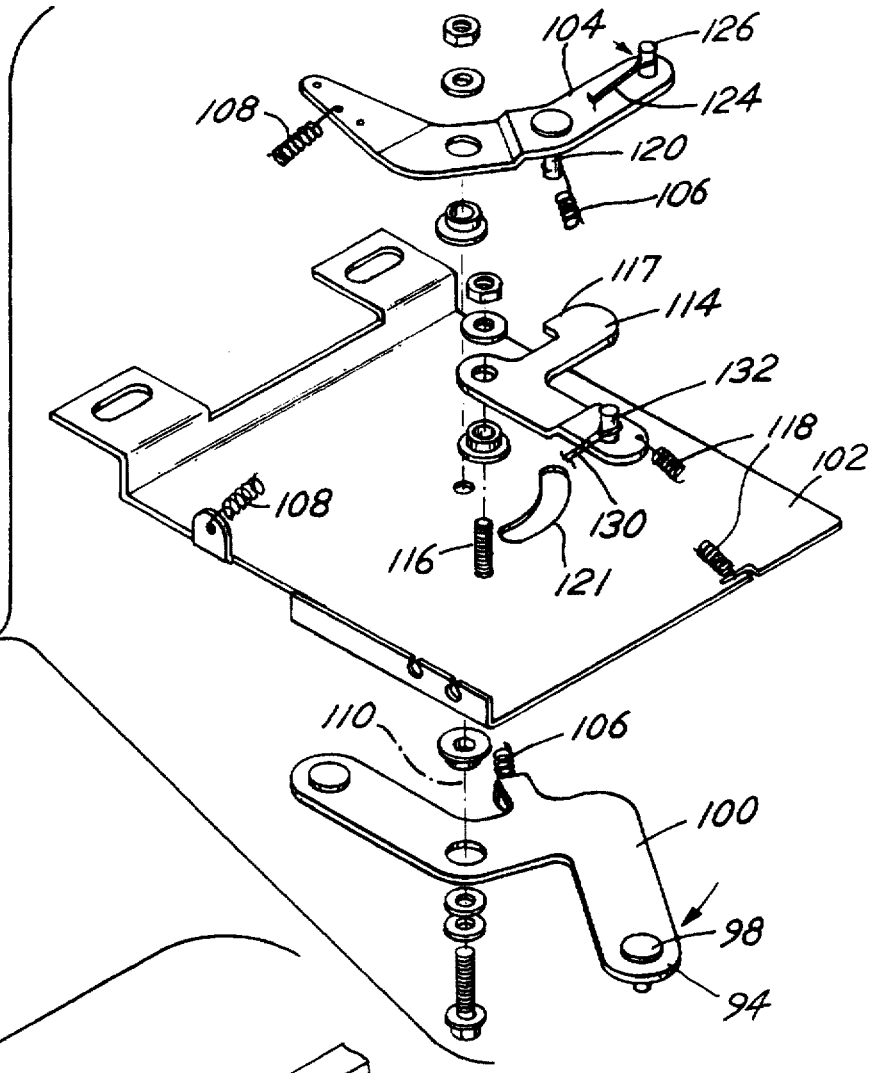
FIG. 13
FIG. 14
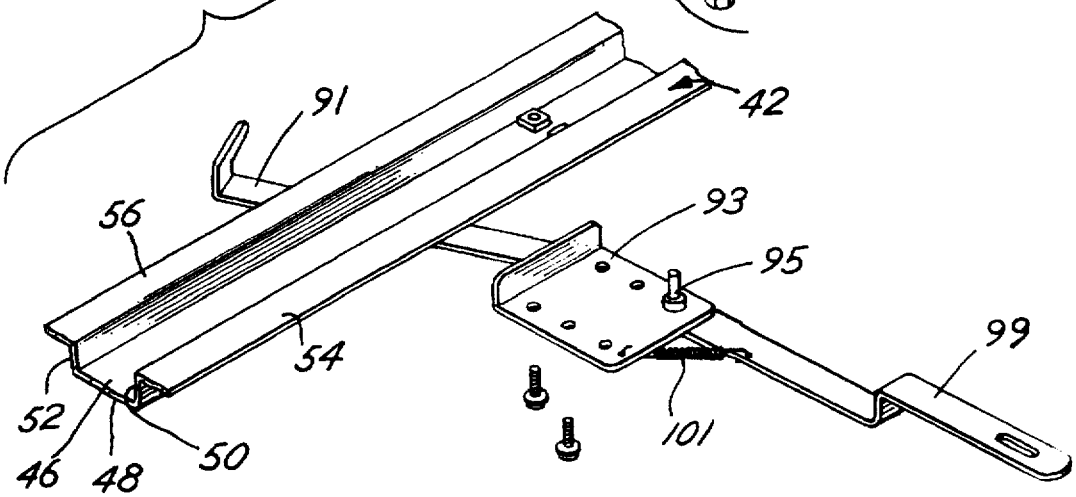

CABINET CONSTRUCTION AND LOCKING SYSTEM

BACKGROUND OF THE INVENTION

Briefly, the present invention relates to a cabinet construction especially useful for heavy duty cabinets which include multiple drawers and a system for locking the drawers in the cabinet.

Tool chests or cabinets are typically made from formed sheet metal. For example, Sulentic in U.S. Pat. No. 3,393,951 discloses a tool chest or cabinet construction wherein sheets of metal are formed and then welded or bolted together to define a cabinet enclosure. Sliding drawers are adapted to slide into an opening defined in the front of the sheet metal cabinet. There are many variations of the design of U.S. Pat. No. 3,393,951, which relies upon the formed sheet metal to define a structural frame as well as a protective enclosure for the drawers. Such constructions are quite useful, especially for cabinets adapted to be used by mechanics for automobile repair, home repair and the like.

However, there are many situations where constructions of the type referenced are not adequate to retain and hold a sufficient supply of heavy tools. That is, in many circumstances, truck mechanics and airline mechanics, for example, require a greater array of tools in a storage cabinet. Yet, the tools must be in a cabinet which is adequately portable. Additionally, the cabinet must have structural integrity and be capable of storing various sizes and types of tools which cumulatively have a great deal of weight and bulk. Thus there has developed a need to provide an improved cabinet construction which is capable of increased capacity, which is mobile and which has the capability of being locked to secure the tools within the cabinet.

BRIEF DESCRIPTION OF THE INVENTION

In a principal aspect, the present invention comprises a multiple drawer, heavy duty cabinet comprised of a series of generally rectangular frame members, each member being formed from channels having a U-shaped cross section. The frame members define an endoskeleton framework and are arranged vertically in a parallel array, one in front of the other. The frame members are interconnected by means of bottom, top and side panel members with an open front. A back panel is attached to the side, top and bottom panels and is adapted to receive a hinged cover. The rectangular frame members include vertical side posts which are adapted to receive slides for drawers. Modular sized drawers may thus be positioned in the cabinet, and the arrangement of the drawers may be altered or changed so that drawers of various depth may be supported in the cabinet by slides which are inserted and supported in appropriate modular drawer retention slide openings in the vertical members of the endoskeleton framework.

Each of the channel members forming the frame members define part of the endoskeleton framework within the cabinet, and each U-shaped channel member includes flanges extending outwardly from the legs of the U configuration of the channel member. The frame members are constructed so that the channels all face outwardly from the interior of the cabinet. The channels serve multiple purposes including the provision of pathways for various locking members and control members for the cabinet.

Optional cross-stringers and mounting slides may be utilized to connect the frame members together. Additional internal, vertical frame members may be positioned within the frames between the sides thereof to permit support of parallel arrays of side-by-side drawers having a width narrower than the total width of the cabinet.

A mechanism for retaining the drawers locked within the cabinet includes a locking mechanism which permits closure of an open drawer, even though the closed drawers are locked. Thus a locking bar within the interior of the cabinet is positioned opposite the backside of the drawers and is operable by means of flexible cables guided through the channels forming the framework, thereby providing protection for the locking mechanism which is easy to install, service and which is protected by the channel members. Further, the locking mechanism enables the hinged cover to remain in an open position but when optionally closed, the cover is locked.

Thus, it is an object of the invention to provide an improved, heavy duty cabinet construction.

It is a further object of the invention to provide an improved, heavy duty cabinet construction comprised of a series of generally rectangular, U-channel frame members arranged in parallel array from front to back within a cabinet construction, and wherein the frame members are interconnected one to the other by means of side, top and bottom panel members.

It is a further object of the present invention to provide an improved, heavy duty cabinet construction having multiple drawers wherein the drawers may be changed in position within the cabinet, and the drawers being modular in terms of depth and width and cooperative with modular slide connectors that are supported by vertical members of the rectangular frame members.

It is a further object of the invention to provide a heavy duty cabinet construction having an internal endoskeleton framework comprised of connected channel members which form a series of frames within the interior of the cabinet.

Yet another object of the invention is to provide an improved cabinet construction having a mechanical locking system which is designed to permit simultaneous locking of all sliding drawers within the cabinet regardless of the array and depth of the drawers.

Another object of the invention is to provide a locking mechanism in a cabinet construction wherein locking of the cabinet drawers is effected by manual manipulation of a lever or pull and subsequent unlocking requires a key actuated operation.

A further object of the invention is to provide a locking mechanism for a heavy duty cabinet which includes control elements and other component parts that fit through the channel members of an endoskeleton framework comprising the cabinet.

Yet another object of the invention is to provide a heavy duty cabinet construction which can be mounted on casters and is mobile.

Another object of the invention is to provide an improved, heavy duty cabinet construction which includes a hinged cover or top which may be locked in a closed position.

Another object of the invention is to provide a cabinet construction which consists of welded, internal frames with outer skin panels attached thereto wherein the welded frames are comprised of horizontal top and bottom frame members and vertical, slide carrier members, the slide carrier members have punched modular openings to receive drawer slides at modular intervals to allow the slides to be attached and relocated easily depending on the size or depth of the drawer.

Yet another object of the invention is to provide an improved, heavy duty cabinet construction which includes a rectangular, internal endoskeleton or framework which is designed to receive caster mounting members so that the casters for the cabinet are attached to the framework.

Yet a further object of the invention is to provide a heavy duty cabinet construction which includes a lock system comprised of vertical bars movable to engage tabs or strikes attached to the backside of drawers wherein a series of one or more continuous vertical bars extending the height of the cabinet permit the drawers to have any depth and wherein the strike or catch associated with each drawer interacts with a vertical locking bar regardless of the vertical position of the strike.

Yet another object of the invention is to provide a locking system for a cabinet which is convertible to cooperate with flush or recessed drawers.

Another object of the invention is to utilize a locking system having flexible cables to actuate the locking system thereby enabling alternative positioning of a lock or actuator for the locking system.

These and other objects, advantages and features will be set forth in the detailed description which follows.

BRIEF DESCRIPTION OF THE DRAWING

In the detailed description which follows reference will be made to the drawing comprised of the following figures:

FIG. 13 is an exploded isometric view of the actuator associated with the locking assembly; and FIG. 14 is a partial isometric view of a frame with an attach lever arm for locking the cover of the cabinet.

DESCRIPTION OF THE PREFERRED EMBODIMENT

In the following description, the preferred embodiment is described as incorporated in a "cabinet." The invention is not, however, limited to a tool cabinet, for example. Rather, the invention may be incorporated in a cabinet of the type which is floor mounted or mounted on casters, or a cart which may also be mounted on casters. The invention may also be incorporated in what is traditionally described or termed a chest, i.e., a chest of drawers or a tool chest. A chest may often be mounted on or placed on the top surface of a cabinet, for example. A chest may or may not include a cover. Thus, in the claims, the term "cabinet" is to be defined in the broadest sense to include cabinets, carts, chests and the like.

Figure 1:
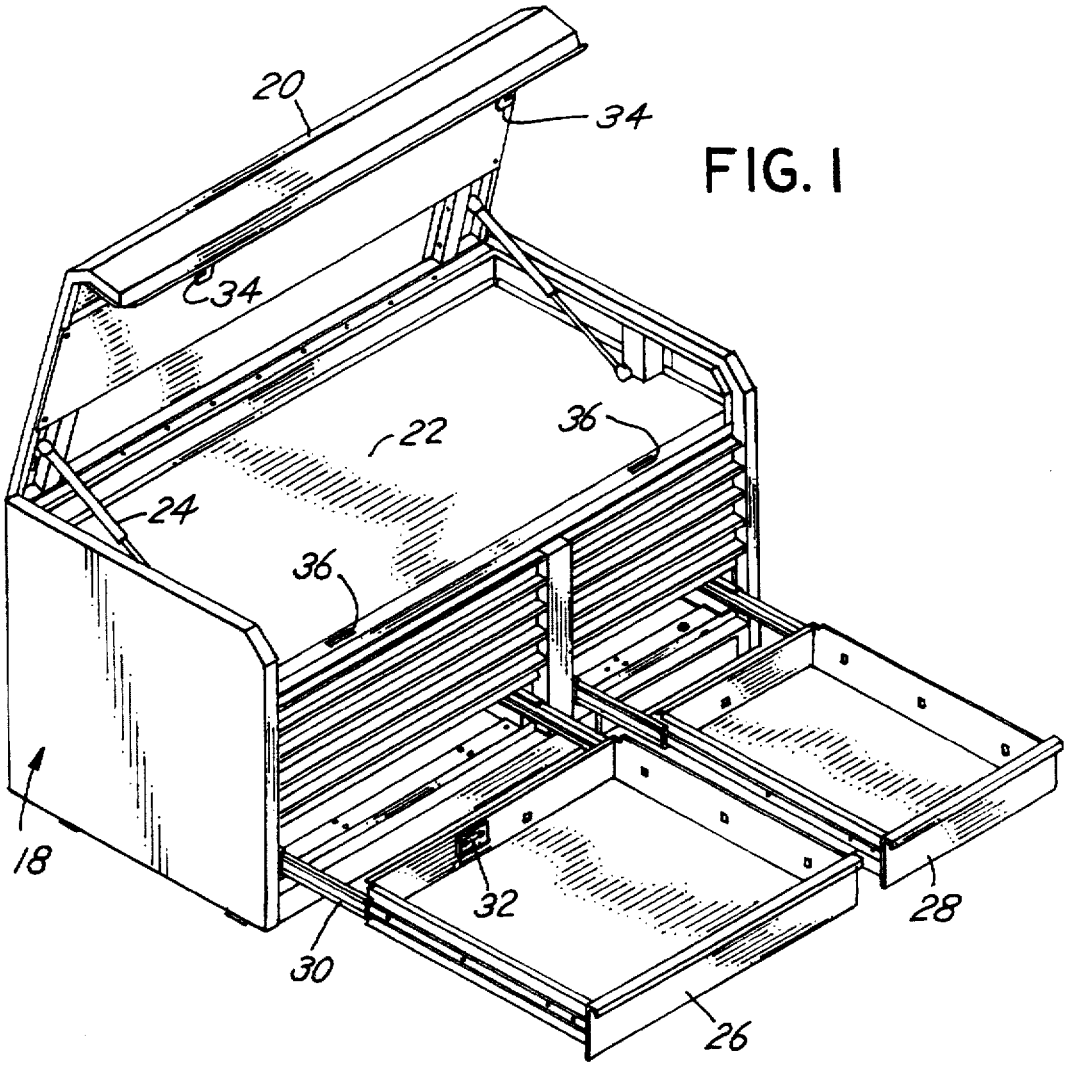
FIG. 1 is an isometric view of a heavy duty tool cabinet which incorporates the features of the invention.

FIG. 1 depicts a typical assembled cabinet 18 (in the generic sense) which incorporates the features of the invention. The particular cabinet 18 depicted in FIG. 1 is a heavy duty cabinet 18 which includes a cover 20 hinged to a back panel 80. A top panel 22 defines a surface and may be enclosed by the cover 20 as a cart to provide an enclosure for storage of large items, for example. Cover 20 is supported by braces 24, for example, gas spring braces. The cabinet 18 further includes a series of slide drawers, such as drawers 26 and 28, which are arranged one above the other on mounting slides such as roller slides 30. The particular depth of each of the drawers 26 and 28 may be varied. In the embodiment depicted in FIG. 1, side by side arrays of drawers 26 and 28 are depicted; however, this is not a limiting feature of the invention. One or more vertical arrays of drawers 26, 28 may be provided. The drawers 26 and 28 may also be locked in a closed position in the cabinet 18. Also the cabinet 18 is designed so that in the event the cabinet 18 is locked, but a drawer (e.g. drawer 26) remains open, the other closed drawers will, nonetheless, be held in a locked position, and the open drawer, when closed, will be locked in the closed position. Further, each of the drawers 26, 28 includes, on the backside thereof, a detent latching element 32 which is disclosed in U.S. Pat. No. 5,435,640, Drawer Catch Construction, incorporated herewith by reference, to prevent the drawers 26, 28 from accidentally sliding open.

The hinge cover 20 may also be locked by the latching mechanism described hereinafter. Also, though the drawers 26, 28 may be locked in a closed position so as not to be removable or opened, the cover 20 may, nonetheless, remain elevated or open as depicted in FIG. 1 or it may subsequently be lowered to a locked or latched position. The locking mechanism for the cover 20 includes projecting locking tabs 34 that fit through slots 36 in the cabinet 18 which are retained in the slot 36 by means of a lever bar 97 in FIG. 14 beneath the top panel 22 by a bar 97 which slides to engage with a slit defined in the side of tab 34. This too is described in greater detail below.

Figure 3:
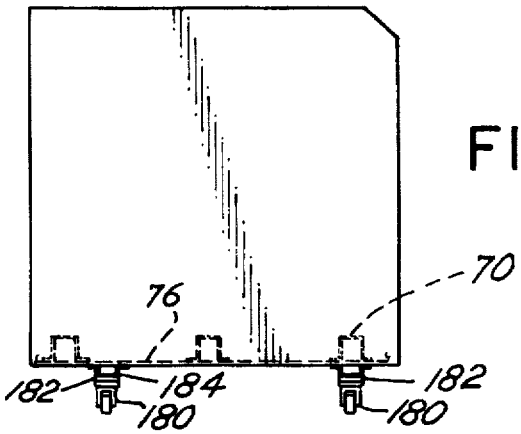
FIG. 3 is a side view of the construction of FIG. 2.
Figure 2:
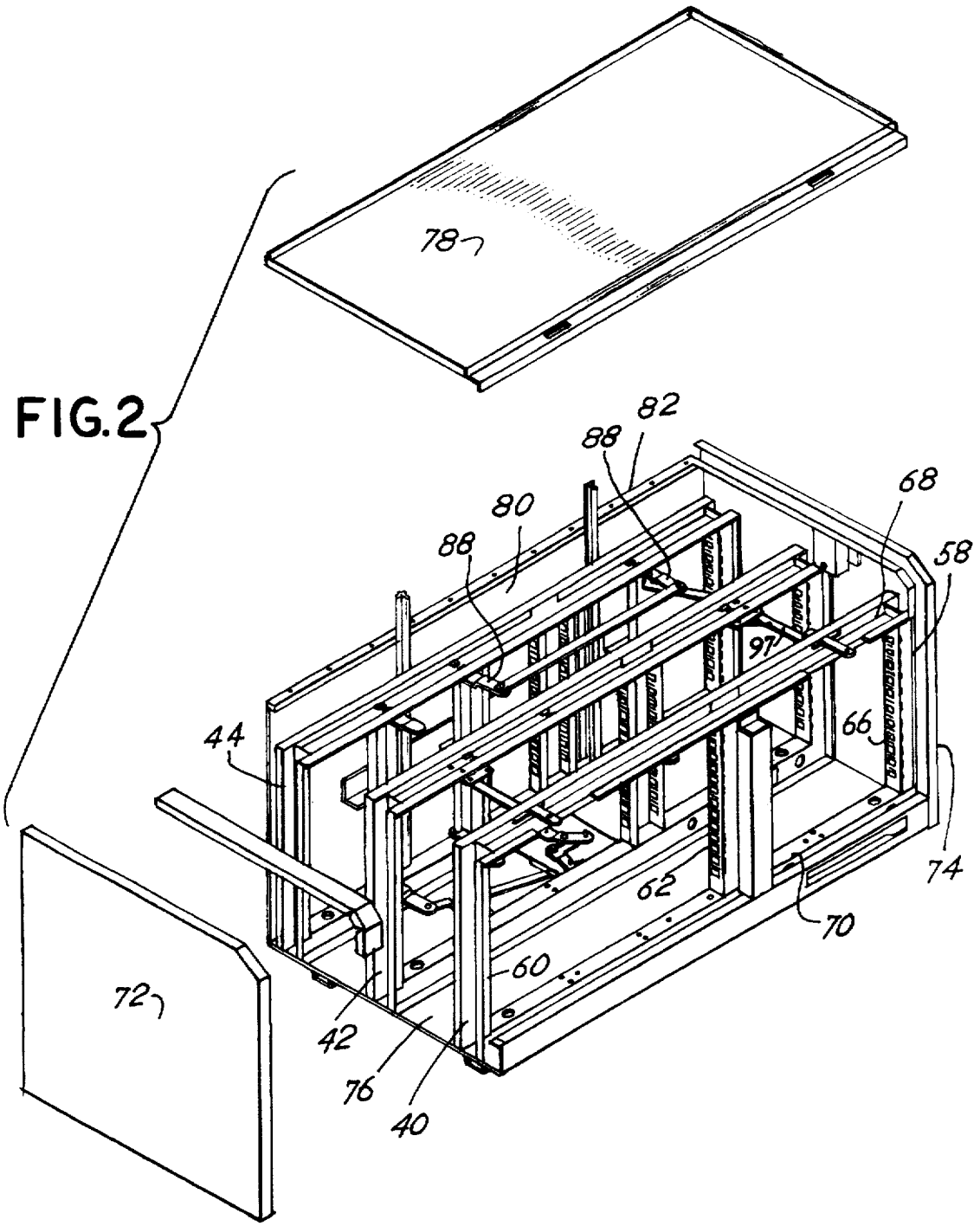
FIG. 2 is an exploded, isometric view of a cabinet incorporating features of the invention.
Figure 4:
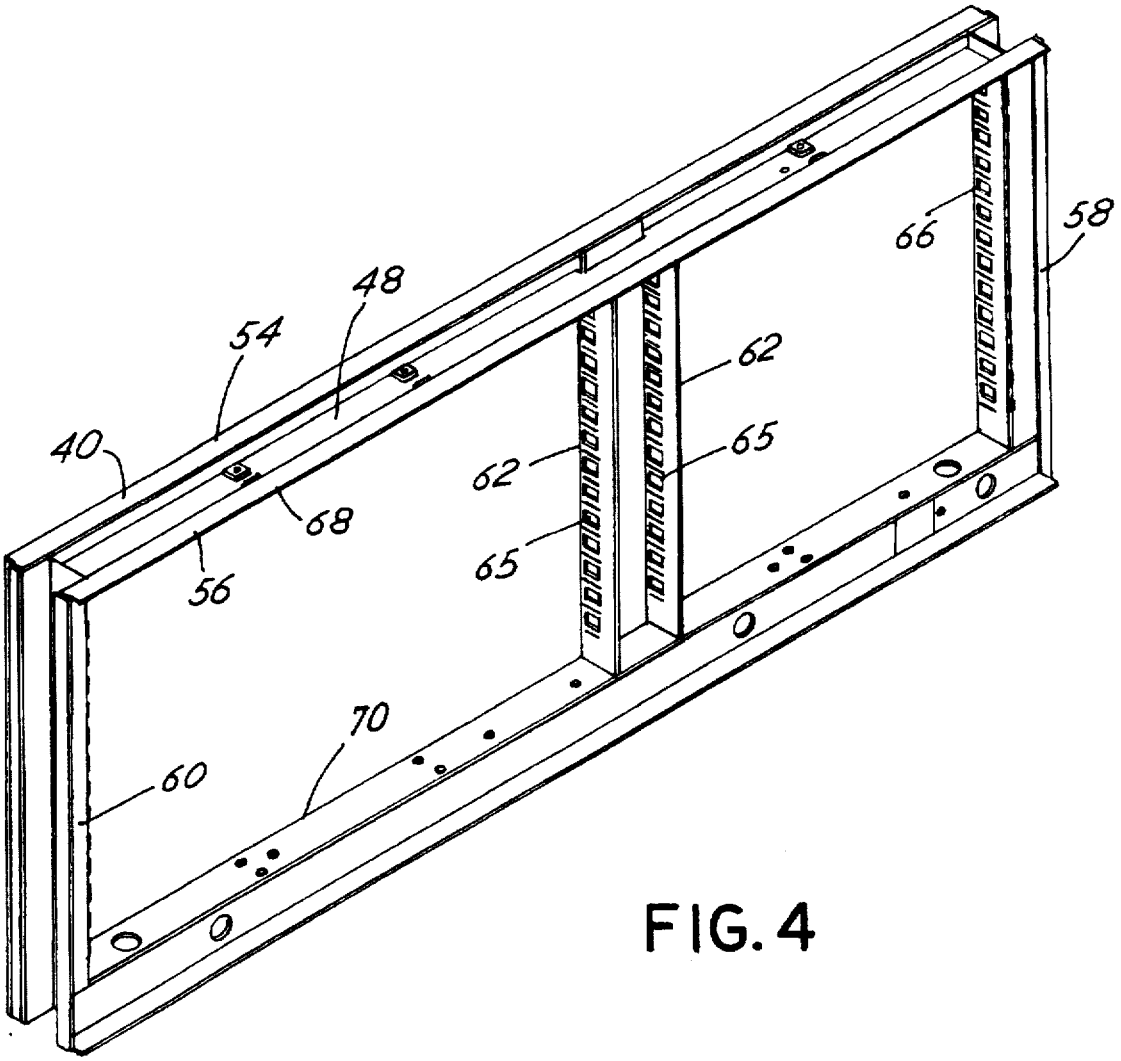
FIG. 4 is an isometric view of an assembled frame utilized in the cabinet construction of the invention, said frame being comprised of channel members having a U-shaped cross section.

FIGS. 2 and 3 depict, in greater detail, the cabinet construction of the invention. The cabinet 18 includes a series of two or more generally rectangular, internal flames or endoskeleton frameworks. In the embodiment depicted, three frames 40, 42, 44 are utilized. Each frame 40, 42 and 44 is substantially identical and thus the following description will apply to the three frames 40, 42, 44 depicted in FIG. 2. Each frame 40 is comprised of a series of substantially identical cross section, U-shaped, channels 46 wherein the channels 46 include coplanar flanges 54, 56 extending outwardly from the ends of the U-shaped channel form. The cross sectional configuration of the channels 46 is depicted, for example, in FIG. 14 as well as FIG. 3 and other figures.

When constructing the frame 40, the preferred embodiment provides that the crown of the U-shaped metal form is positioned toward the inside of the rectangle defined by the frame 40. Thus the channel 46 in FIG. 14 is defined by a crown section 48 and opposed, spaced leg sections 50 and 52 with outwardly extending, coplanar flanges 54 and 56 extending from the ends of the leg sections 50, 52. A circumferential slot or pathway thus extends about the frame 40. The frame 40 is formed by at least first and second vertical channel members 58 and 60 which are constructed to be slide carrier members. Thus the crown section 48, of vertical members 58, 60, include a series of modular openings 66 that may receive and support drawer slides. The vertical slide carrier members 58 and 60 comprise the outside edges of each generally rectangular frame 40. Additional internal vertical slide carrier members 62 may be incorporated within the frame 40 to provide a vertical array of internal slots or openings 65 for receipt of drawers 26, 28. Note that internal members 62 may have a box form or other cross sectional form. Thus the vertical slide carrier members 58, 60 and 62 all include a series of modular positioned openings, such as openings 65, 66 which are uniformly spaced along the vertical extent of the slide carrier members 58, 60 and 62. The openings 65, 66 are adapted to cooperate with drawer slide members to mount drawers 26 and 28. The outside members 58, 60 have the same U-shaped channel configuration as top and bottom channel members 68, 70.

In the embodiment shown, there are three frames 40, 42 and 44. The frames 40, 42 and 44 have a substantially identical construction, including substantially identical size and configuration. Each of the frames 40, 42 and 44 are thus generally rectangular and are optionally subdivided by internal, slide carrier members 62. The frames 40, 42 and 44 also include an upper channel member 68 and a parallel, lower channel member 70. Again, the channel members 68 and 70 are U-shaped metal channels having substantially the same cross sectional configuration as the vertical slide carrier members 58 and 60.

The frames 40, 42 and 44 are arranged in vertical, parallel array. The rear frame 44 is positioned slightly back of the inward extent of drawers 26, 28 which fit into the cabinet 18 for reasons that will be explained below. The frames 40, 42 and 44 include openings 66 for the drawer slide members and are arrayed so that the drawers 26, 28 will slide into and out of the cabinet 18 along a substantially horizontal oriented plane.

The frames 40, 42 and 44 are all connected together by means of various panel members. More particularly, a side panel 72 and a side panel 74 are welded to the flanges 54 and 56 of the vertical, slide carder members 58 and 60. A lower or bottom panel 76 is similarly welded to the lower channel members 70. A top panel 78 is welded to flanges 54 and 56 of the upper channel member 68. The side panels 72, 74, bottom panel 76 and top panel 78 define the structure which maintains the frames 40, 42 and 44 in assembled condition. The frames 40, 42 and 44 thus define an endoskeleton for supporting and connecting with the side panel 72, 74 and bottom panel 76 and top panel 78. Note that stringers (not shown) may be provided to structurally connect frames 40, 42, 44.

The frames 40, 42 and 44 thus define the assembly which directly and structurally supports the drawers 26, 28 and the contents of drawers 26 and 28. The structural integrity of the assembly or construction of the cabinet is consequently maintained by the endoskeleton comprised of the frames 40, 42 and 44 which are fixed relative to one another by the panels 72, 74, 76 and 78. A back side or back panel 80 is attached to the panels 72, 74, 76 and 78. The back panel 80 includes a hinge connection member or leaf 82 along its upper rim or edge which coacts with a leaf and hinge pin of cover 20 as previously described. The cover 20 is not depicted in FIG. 2.

Note that the side panels 72, 74 and back panel 80 are of greater height than the vertical, slide carrier members 5g and 60 in the embodiment of FIG. 2. This cover 20 is thus in the form of a hood to provide a space over the top panel 78 when cover 20 is closed. Tools and other items may be maintained in the space defined between the top panel 78 and cover 20.

Figure 5:
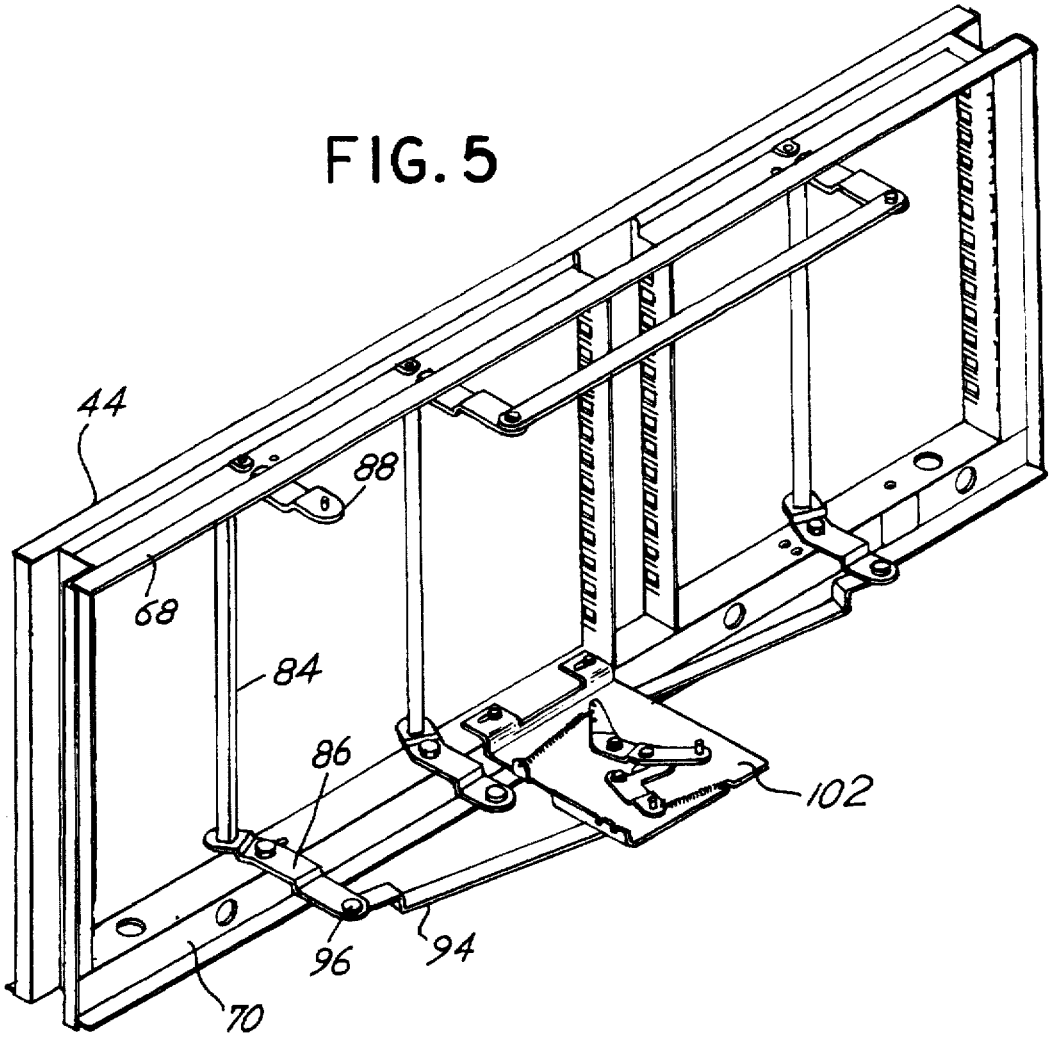
FIG. 5 is an isometric view, similar to FIG. 4, depicting a locking mechanism associated with the cabinet construction of the invention.

Referring next to FIG. 5, the construction of frame 44 is depicted with certain lock assembly components or elements attached thereto and mounted thereon. FIGS. 5 through 14 collectively depict the locking elements. Referring to these figures, the frame 44 includes one or more vertical locking bars 84 each mounted on a pivoting lower leg 86 and an upper leg 88. The vertical locking bars 84 are welded to or otherwise attached to the legs 86 and 88. The legs 86 and 88 have substantially the same construction. Lower leg 86 is pivotally attached to lower channel member 70 and upper leg 88 to upper channel member 68.

Figure 6:
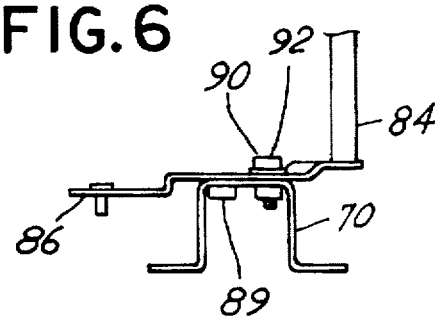
FIG. 6 is a side elevation of the locking bar mounting construction of FIG. 5 positioned for coaction with recessed drawers.
Figure 7:
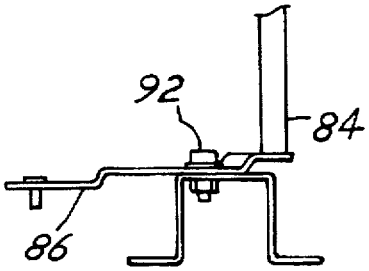
FIG. 7 is a side elevation, similar to FIG. 6, wherein locking bars are mounted for coaction with flush drawers.

FIGS. 6 and 7 depict in greater detail the manner of attachment of the leg 86 to the channel 70. The channel 70 has two pivot attachment positions 89, 90. These two position are represented in FIGS. 6 and 7 as a forward pivot position 89 and a rearward pivot position or connection 90. The pivot position 90 is associated with recessed drawers 26, 28. Thus when leg 86 is fixed in the position of FIG. 6, the leg 86 is attached by a pivot bolt 92 through the pivot connection 90. In this position, the lock bar 84 is moved or maintained toward the rear or back panel 80 (not shown in FIG. 6). Thus drawers 26, 28 positioned within the cabinet 18 may be recessed or positioned more deeply into the cabinet 18 and locked by the locking bar 84 which itself is positioned more deeply into the cabinet 18.

FIG. 7 represents the arrangement of the leg 86 when the leg 86 is attached in the pivot position 89 associated with flush mounted drawers 26, 28. When in the flush mounted position, the locking bar 84 is positioned forwardly of the position depicted in FIG. 6. In other words, the vertical lockbar 84 is positioned forwardly of back panel 80 and slightly closer to the front opening of the cabinet 18. When locking bar 84 is in the forward position illustrated in FIG. 7, the cabinet 18 is arranged to receive flush mounted drawers 26, 28 and retain the drawers 26, 28 in a locked position by the locking bar 84.

The locking bars 84 are pivoted clockwise or counterclockwise between locking and unlocking engagement positions with strikes 85 located on the back side of each sliding drawer 26, 28. Bars 84 move in response to pivotal movement of legs, e.g. leg 86. Thus the lower leg 86 is driven or pivoted by means of a link 94 which, in turn, responds to actuator levers. Link 94 has one end attached to the lower leg 86 by a pivot connection 96. The opposite end of the link 94 is attached to a pivot connection 98 on a pivot weldment or lever arm 100 which is pivotally mounted on an actuator bracket 102 attached to lower channel member 70 of the frame 44. The lever arm 100 is normally biased in the counterclockwise direction as depicted in FIG. 13 and the other Figures. The lever arm 100 is keyed to a spring retaining lever arm 104 mounted on the same pivot axis 110 as the lever arm 100. Arm 104 is positioned on the opposite side of the bracket 102 from arm 100. The lever arm 100 thus actuates or rotates with the arm 104 due to the connection of pin 120 via spring 106 to arm 104.

Figure 11:
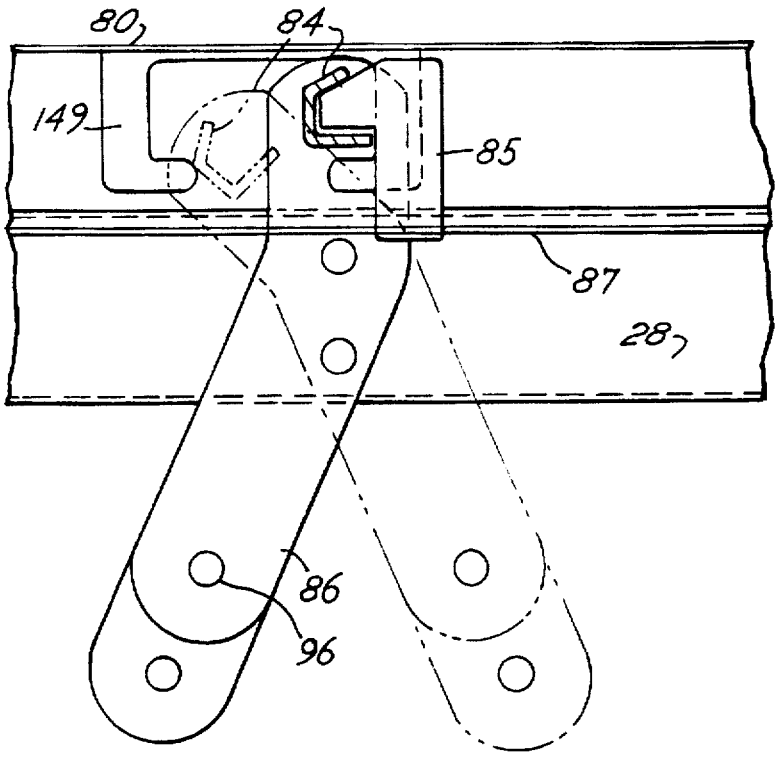
FIG. 11 is a top plan view of a typical drawer strike mechanism cooperative with a locking bar to retain the drawers in a locked position.

Thus spring 106 connected from arm 100 to pin 120 projecting through slot 121 in plate or bracket 102 normally biases the arm 100 in the counterclockwise direction in FIG. 13. Slot 121 limits movement of arm 100. Similarly, a spring 108 connected from arm 104 to bracket 102 biases the lever arm 104 about pivot axis 110. The link 94, being attached to the pivot pin 98, normally maintains the locking bar 84 in the open or unlocked position. This open position is illustrated in FIG. 11 in phantom. FIG. 11 also illustrates in solid lines, the position of the locking bar 84 when it engages a shaped strike 85 attached to a rear panel 87 of a drawer 26.

A locking pawl 114 is pivotally mounted on a pin 116 on the bracket 102 and is biased by a spring 118 connected to the bracket 102 in the counterclockwise direction in FIG. 13. The latch bar or locking pawl 114 includes a locking lug 117 which may engage with the depending pin or lug 120 associated with the lever arm 104. Lever arm 104 further includes a flexible cable 124 attached to a pin 126. The locking pawl 114 includes a key actuated flexible cable 130 attached to a pin 132.

Figure 8:
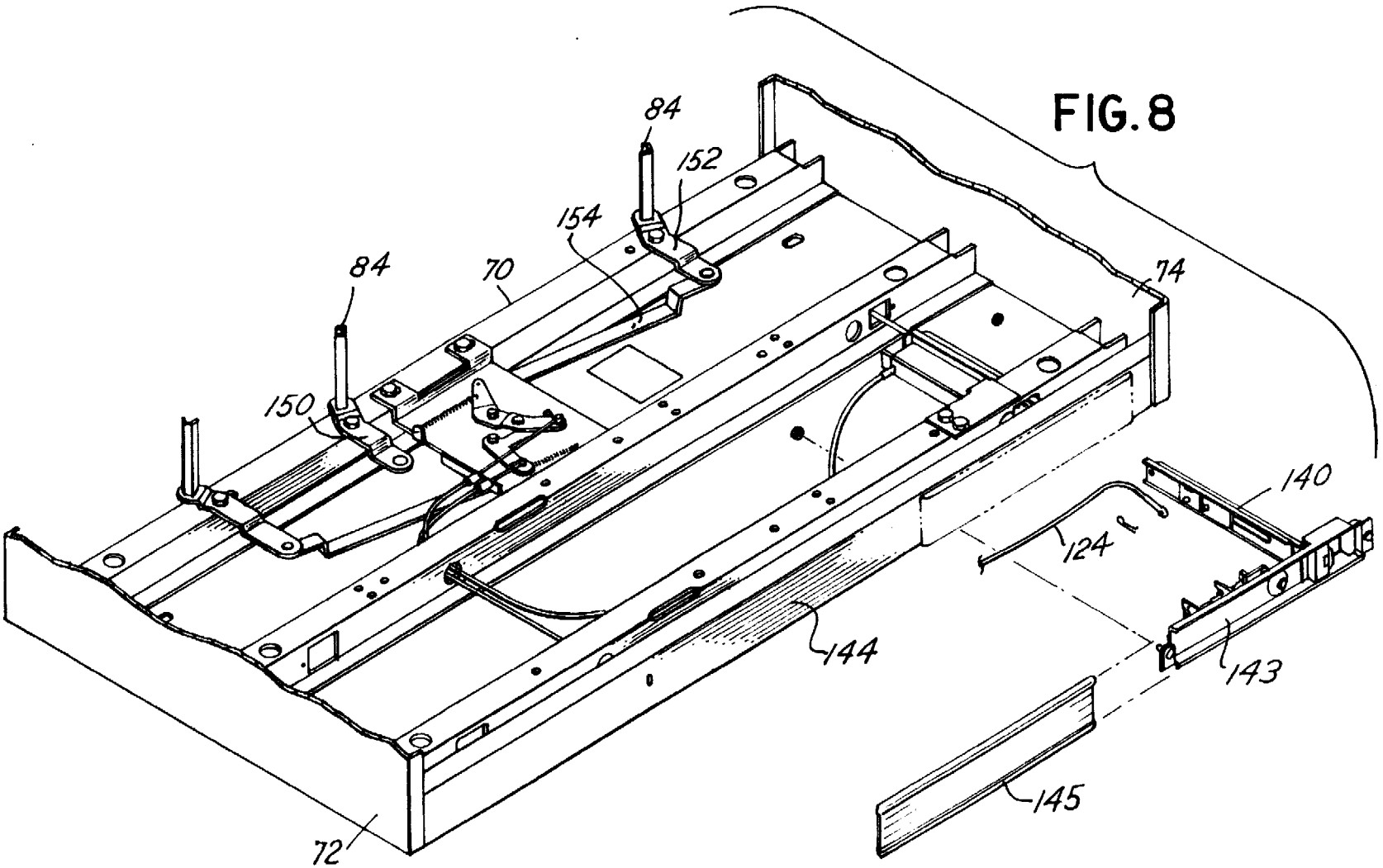
FIG. 8 is an isometric view illustrating the lock mechanism utilized to operate the locking bar mechanism.
Figure 9:
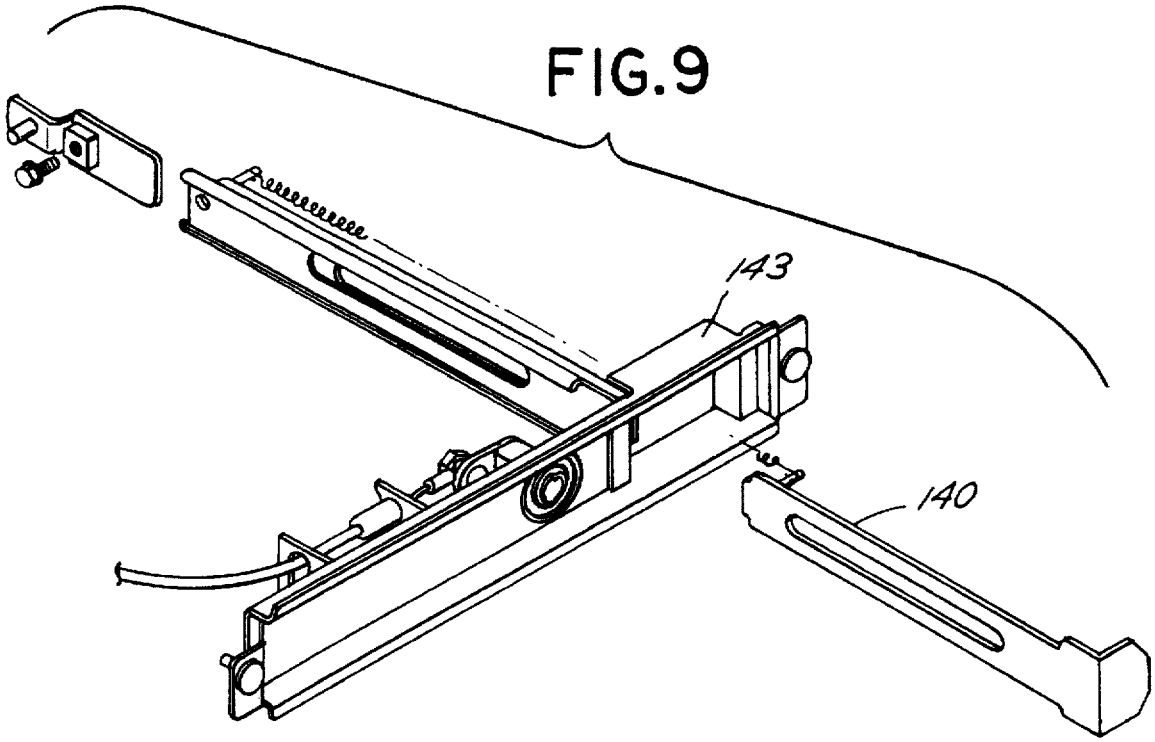
FIG. 9 is an enlarged, partial isometric view of the lock actuator assembly for the locking bar mechanism.
Figure 10:
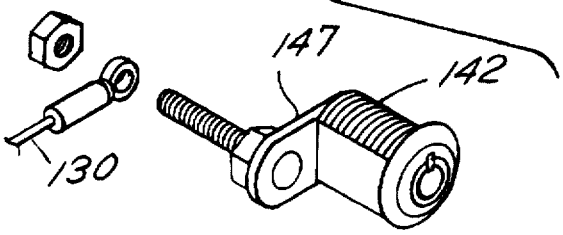
FIG. 10 is an enlarged isometric view of the lock used in the locking mechanism of FIG. 9.

The operation of the latch bar assembly depicted in FIGS. 5–13 is effected by the flexible cables 124 and 130 associated respectively with a manual pull latch bar 140 depicted in FIGS. 8 and 9 and a key operated cylinder lock 142 as depicted in FIGS. 8, 9 and 10. Thus the lock lever bar 140 attaches to cable 124 and when pulled outwardly from the lock lever housing or weldment 143, which is mounted in the cabinet 18 and more particularly on a crossbeam 144 attached between side panels 72 and 74 of the cabinet, cable 124 pulls on pin 126 and pivots arm 104. The bar 140 is retained within housing 143 which is covered by a sliding cover 145 to protect access to the bar 140 as well as the cylinder lock 142. Pulling outwardly on the locking lever or bar 140 thus causes the flexible cable 124 to be engaged and pulled. This causes the pivot arm or lever 104 to be moved clockwise against the force of the biasing spring 108. When moved to the clockwise position, limited by movement of pin 120 in slot 121, by actuation of the lever bar 140, simultaneous clockwise movement of the lever arm 100 results. Link 94 is thus moved to pivot leg 86 causing the vertical locking bar 84 to pivot into a position of engagement with the drawer strike 86 such as depicted in FIG. 11. When rotated to the position described, the locking pawl 114, which is biased by the spring 118, pivots in the counterclockwise direction to engage the locking leg 117 with the pin 120. This holds the lever 104 in a fixed or locked position, thereby retaining the locking bar 84 in a fixed or locked position engaged with drawer strikes 85. Note a drawer 26 may be closed against the strike bar 84 in the locked position because the strike 85 can drive the bar 84 open to receive the strike 85. The bar 84 will immediately return to the locked position however due to the clockwise force of spring 106.

Note also that the bar 140 is spring biased to the recessed position. Pulling on bar 140 locks the drawers 26, 28 without operation of a key and release from the locked position requires key actuation as described below. Consequently, the cabinet can be easily locked independent of keyed operation.

To release the locking bar 84 from its locked position of engagement with strikes 85, the cylinder lock 142, having a bolt or lug 147 attached to the flexible cable 130, may be actuated by rotational movement in either direction to cause the cable 130 to pull on the pin 132 thereby moving the locking pawl 114 in a clockwise direction as depicted in FIG. 14 against the force of the spring 118. This releases the locking pawl 114 from engagement with the pin 120. The springs 108 and 106 then cause the various lever arms 100 and 104 to move in the counterclockwise direction thereby actuating the link 94 and leg 86 to pivot and release the locking bar 84 and moving the locking bar 84 to the position depicted in FIG. 11 in phantom. It is to be noted that the locking bar 84 thus is released from the strike 85. Also the pivotal travel of the locking bar 84 is limited by a lock bar stop 149 attached to the back panel 80.

Additional legs, such as legs 150 and 152, may be mounted on the lower channel member 70 for cooperative engagement by various link arms, such as link arm 154, with the actuating lever arms pivotally attached thereto to effect movement of one or more locking bars 84 positioned at the back of the cabinet construction. Again, the legs, such as legs 150 and 152, may be positioned to accommodate a recessed as well as flush-mounted drawers 26, 28.

The drawer construction utilizes any typical type of slide for mounting the drawers 26, 28 on the vertical slide carrier members 58, 60, 62. For example, Sevey U.S. Pat. No. 4,681,381 discloses a type of slide which may be used. Maxwell in U.S. Pat. No. 3,123,419 as well as Gomersall in U.S. Pat. No. 2,859,070 all depict various types of slides which could be used with the invention assuming the slide mechanisms can be moved vertically upwardly and downwardly for coaction with the modularly positioned openings 66 in the vertical slide carrier members 58, 60 and 62.

Figure 12:
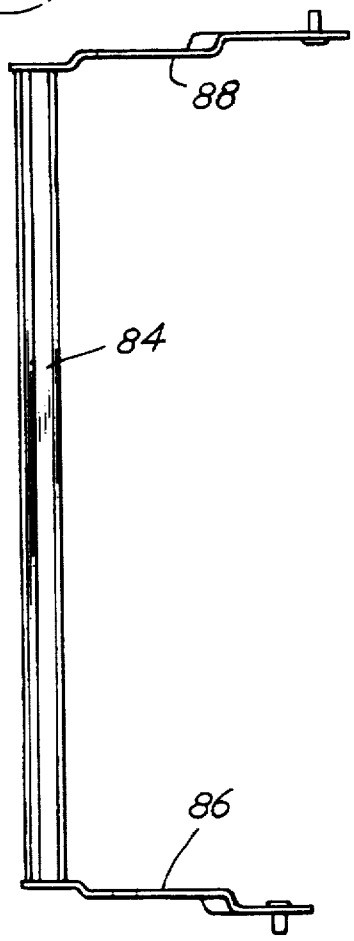
FIG. 12 is a side elevation of a locking bar.

As noted in FIG. 12, the vertical locking bar 84 may be actuated by leg members such as leg member 86 which coacts with lower channel member 70 or an upper leg 88A which coacts with upper channel member 68. That is, the locking system may operate leg members either at the top or bottom of the cabinet 18 depending upon the desired cabinet design. As stated before, one or more locking members 94 may also be utilized.

FIGS. 2 and 14 illustrate a further feature of the invention. That is, the upper legs 88A may be linked by a linkage arm 91 attached by a pivot attachment plate 93 to a channel member such as channel member 42. The linkage arm 91 which pivots about a pin 95 includes an active cover tab engagement arm 99 which coacts with or engages with the tab 34 projecting through a slot 36 as previously described. The linkage arm 91 is normally pivotally driven by leg 88A, for example, so that the arm 99 will not engage with the tab 34. However, upon movement of the arm 88A in conjunction with movement of the locking bar 84 to a locking position, the link or arm 99 is moved to engage tab 34. Since the linkage arm 91 is pivotally biased by a spring 101, the engagement 99 arm may be in the closed position or locked position but will bias or permit biasing thereof whenever the tab 34 is inserted through the slot 36. Thus the cover 20 may be open while the drawers 26, 28 are locked. The cover 20 may then be dropped so that the tab 34 fits through slot 36 and the cover 20 will then be locked in position.

Various combinations of the elements of the invention as described may be constructed. Multiple arrangements of drawers are possible. It is noted that regardless of the number of drawers, only a single locking bar 84 is required though multiple bars may be used. The locking bar 84 need not be altered or changed or adjusted in order to coact with any number of drawers of any variety of depth. All that need be provided is a strike on the rear panel of each drawer.

Also, the flexible cable locking system may be positioned at the bottom or top of the cabinet. Further, it is noted that the flexible cables and other linkage members fit through and are incorporated into the channels of the frames 40, 42 and 44. In this manner, the various component parts are separated from the drawers 26, 28 and are operative without interference with movement of the drawers 26, 28.

Referring to FIGS. 1 and 3, there is depicted the manner by which casters may be supported and attached to the cabinet 18. That is, U-shaped channels, such as channel 70, may be adapted to receive brackets 182 attached thereto passing through the bottom panel 78. The brackets 182 support casters 180. Alternatively, inverted U-shaped channel members 184 may be positioned on the bottom side of the bottom panel 78 and attached to channel 70. Thus an inverted U-shaped channel 184 may be welded or attached to the bottom panel 78. A bracket 182 and caster 180 may be then attached thereto.

In certain circumstances, one may position a tool chest on a cabinet. Typically, the chest would be supported or mounted on the top surface of the cabinet. In such an event, the chest and cabinet may have independent locking and unlocking mechanisms as described above. Thus, the chest would include a lever bar 140 to effect locking of the chest drawers and a separate lever bar 140 to effect locking of the cabinet upon which the chest is mounted. Also, the chest would include its own lock to release the locking bar 84 as would the cabinet.

However, with the present invention, the chest and cabinet may simultaneously be locked and unlocked by a single lever bar 140 and key operated lock. This results because flexible cables are used in the practice of the invention. Thus the locking cables from both a chest and cabinet may be attached to a single lever bar 140, for example, mounted in the lower cabinet. Likewise, the unlocking cables from both a chest and cabinet may be attached to the bolt or actuating arm of the key lock in the cabinet, for example.

While there has been put forth a description of preferred embodiments, it is to be understood that the invention is to be limited only by the following claims and their equivalents.

What is claimed is:

1. A multiple drawer, heavy duty tool cabinet comprising, in combination:

first and second spaced, parallel, lower channel members;

first and second spaced, parallel upper channel members, said upper and lower channel members having an equal length, said channel members each having an outwardly open channel;

first, vertical, slide carrier members connecting the ends of the first channel members to define a first endoskeleton framework for the cabinet;

second, vertical, slide carrier members connecting the ends of the second channel members, to further define a second endoskeleton framework for the cabinet, said slide carrier members having a series of uniformly spaced, drawer slide engagement slots, said slots uniformly spaced vertically along the length of the slide carrier members to define multiple drawer slide carrier mounting slots for drawers of various depth;

opposite side, bottom, back and top side panels affixed to the first and second frameworks of channel members and slide carrier members to define an enclosure for the cabinet with a front access opening for receipt of sliding drawers, the side, top and bottom panels defining structural elements to maintain parallel spacing of the first and second endoskeleton frameworks; and a plurality of slide drawers mounted for sliding movement from the front into and out of the endoskeleton frameworks, said drawers supported solely on the vertical, slide carrier members by drawer slides engaged with the slide engagement slots;

said cabinet further including a drawer locking mechanism mounted on the endoskeleton framework comprising, in combination:

the first endoskeleton framework member positioned behind the maximum internal movement of sliding drawers;

at least one vertical locking bar;

a horizontal leg pivotally mounted on one of said first channel members supporting the vertical locking bar, said leg pivotal between a biased open position and a closed drawer locking position;

a control handle;

a flexible cable linked to the horizontal leg at one end and to the control handle at its opposite end for pivoting the locking bar to the drawer locking position;

a biasing spring for maintaining the horizontal leg in the drawer locking position;

a release control;

a second flexible cable connecting the release control to the biasing spring for releasing the biasing spring from the drawer locking position, said flexible cables extending through channels in the channel members, said locking bar and release control also mounted on one of said channel members.

2. The cabinet of claim 1 wherein all of the channels have a U-shaped cross section with projecting flanges from the outer ends of the legs of the U-shape to define planar surfaces for receipt and attachment of the panels with an open channel space, defined by the internal portion of the U-shape and the panel, for receipt of control elements and other elements.

3. The cabinet of claim 1 including a hinged cover extending over the top panel and hinged to the back panel.

4. The cabinet of claim 1 including a hinged cover extending over the top panel and hinged to the back panel, said cover including a locking tab, a pivotal engagement arm supported by one of said upper channel members, said locking tab normally biased to be disengaged from the engagement arm when the cover is in a closed position over the top panel, said engagement arm pivotal to a cover latching position by the first flexible cable when activated to the drawer locking position and released to the normally unengaged position when the control is released from the drawer locking position.

5. The cabinet of claim 1 further including casters attached to at least one of the lower channel members.

6. The cabinet of claim 1 further including caster support channel members having a U-shaped cross section attached to the bottom panel on the outside thereof and casters attached to the caster support channel members.

* * * * *